US008720886B2

(12) United States Patent
Kuroda et al.

(10) Patent No.: US 8,720,886 B2
(45) Date of Patent: May 13, 2014

(54) SHEET CONVEYING APPARATUS AND IMAGE FORMING APPARATUS

(75) Inventors: Akira Kuroda, Numazu (JP); Atsushi Ogata, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/824,034

(22) PCT Filed: Oct. 5, 2011

(86) PCT No.: PCT/JP2011/073466
§ 371 (c)(1),
(2), (4) Date: Mar. 15, 2013

(87) PCT Pub. No.: WO2012/050145
PCT Pub. Date: Apr. 19, 2012

(65) Prior Publication Data

US 2013/0187330 A1 Jul. 25, 2013

(30) Foreign Application Priority Data

Oct. 13, 2010 (JP) ..... 2010-230413

(51) Int. Cl.
*B65H 5/00* (2006.01)
*B65H 85/00* (2006.01)

(52) U.S. Cl.
USPC ..... 271/225; 271/3.2; 271/3.18; 271/3.03; 399/364

(58) Field of Classification Search
USPC ..... 400/188; 399/364; 271/3.18, 3.2, 225, 271/3.03
See application file for complete search history.

(56) References Cited

U.S. PATENT DOCUMENTS 5,008,713 A * 4/1991 Ozawa et al. ..... 399/402
5,093,690 A * 3/1992 Ohno et al. ..... 399/402
5,572,308 A * 11/1996 Suda et al. ..... 399/401
5,907,745 A 5/1999 Azuma et al.
6,325,371 B1 12/2001 Araki et al.

(Continued)

FOREIGN PATENT DOCUMENTS

JP H03-013463 A 1/1991
JP 2004-051330 A 2/2004
WO 03/066483 A 8/2003

OTHER PUBLICATIONS

Notification Concerning Transmittal of International Preliminary Report on Patentability (Chapter I of the Patent Cooperation Treaty), issued by The International Bureau, on May 7, 2013, in International Application No. PCT/JP2011/073466.

*Primary Examiner* — Patrick Cicchino
(74) *Attorney, Agent, or Firm* — Fitzpatrick, Cella, Harper & Scinto

(57) ABSTRACT

A sheet conveying apparatus which conveys a sheet, including: a first conveying path along which the sheet is conveyed; a second conveying path along which the sheet is reconveyed to the first conveying path; a reverse conveyance roller pair, which performs forward rotation to convey the sheet from the first conveying path and reverse rotation to convey the sheet to the second conveying path; a reconveying roller pair disposed in the second conveying path; and a control portion which causes the reconveying roller pair to nip a preceding sheet and a succeeding sheet in an overlaid manner, and thereafter rotates a first roller that is in contact with the preceding sheet while stopping rotation of a second roller that is in contact with the succeeding sheet so that the preceding sheet is conveyed to the first conveying path and the succeeding sheet stays in the second conveying path.

14 Claims, 12 Drawing Sheets

(56) References Cited

U.S. PATENT DOCUMENTS

| | | | | |
|---|---|---|---|---|
| 6,382,614 | B1 | 5/2002 | Fukatsu et al. | |
| 6,382,616 | B1 | 5/2002 | Waragai et al. | |
| 6,561,503 | B1 | 5/2003 | Ogata et al. | |
| 6,637,996 | B1 | 10/2003 | Hayakawa et al. | |
| 7,331,647 | B2 * | 2/2008 | Nakanishi et al. | 347/16 |
| 7,753,368 | B2 | 7/2010 | Sekiyama et al. | |
| 7,874,558 | B2 | 1/2011 | Ogata et al. | |
| 7,992,854 | B2 * | 8/2011 | Mandel et al. | 270/58.01 |
| 8,038,147 | B2 | 10/2011 | Ogata et al. | |
| 8,061,712 | B2 | 11/2011 | Tsuji et al. | |
| 8,382,109 | B2 | 2/2013 | Tsuji et al. | |
| 8,444,141 | B2 | 5/2013 | Sekiyama et al. | |
| 2006/0072138 | A1 * | 4/2006 | Nakanishi et al. | 358/1.12 |

* cited by examiner

SHEET CONVEYING APPARATUS AND IMAGE FORMING APPARATUS

TECHNICAL FIELD

The present invention relates to a sheet conveying apparatus and an image forming apparatus.

BACKGROUND ART

In recent years, there has been a demand for further resource savings of an image forming apparatus, and duplex printing has been increasingly utilized to meet the demand. Therefore, in an image forming apparatus having a duplex printing function, higher duplex printing speed is demanded to enhance production efficiency.

In order to attain higher printing speed in the image forming apparatus having the duplex printing function, for example, blank paper and paper printed on one side are alternately conveyed at the same interval as in a case of one-side printing. By alternately printing the blank paper and the paper printed on one side, higher printing speed can be attained. Therefore, it is necessary to reverse and convey at least two sheets of paper printed on one side in the early stage, which are to be conveyed at the start of the duplex printing, and bring the respective sheets into a standby state.

Meanwhile, a conventional image forming apparatus having a duplex printing function has the following structure. That is, when the duplex printing is performed, two sheets at the start of printing are brought into a standby state by stopping the preceding sheet at a preceding-sheet stop position and stopping the succeeding sheet at a succeeding-sheet stop position, respectively (see PTL 1).

The preceding-sheet stop position and the succeeding-sheet stop position are preset depending on an image forming apparatus to be used, and hence cannot be changed according to the size of the sheet to be printed. Therefore, in the conventional image forming apparatus disclosed in PTL 1, even in a case of a small-size sheet, the interval (printing interval) between the preceding sheet and the succeeding sheet cannot be reduced, with the result that an unnecessary printing interval is provided. Then, such an unnecessary printing interval suppresses the increase in printing speed.

In contrast, there is disclosed an image forming apparatus in which two conveying paths that allow the preceding sheet and the succeeding sheet to stand by are provided in parallel, and the printing interval (conveyance interval) is reduced by causing the respective sheets to stand by on the conveying paths (see PTL 2). However, in the conventional image forming apparatus disclosed in PTL 2, the two conveying paths are provided, and hence it is necessary to provide a structure for alternately sorting the sheets to the respective conveying paths, and a structure for alternately reconveying the sheets to an image forming portion. As a result, the apparatus becomes complex and the manufacturing cost increases. Though the image forming apparatus has been required to be downsized in recent years, the two conveying paths provided in parallel upsize the entire image forming apparatus, and hence are regarded as an obstacle to the request for downsizing.

CITATION LIST

Patent Literature

PTL 1: Japanese Patent Application Laid-Open No. H03-013463

PTL 2: Japanese Patent Application Laid-Open No. 2004-051330

SUMMARY OF INVENTION

Therefore, the present invention has an object to provide a sheet conveying apparatus and an image forming apparatus which are capable of enhancing productivity in duplex printing with a simple structure.

The present invention provides a sheet conveying apparatus which conveys a sheet, including: a first conveying path, along which the sheet is conveyed; a second conveying path, along which the sheet conveyed from the first conveying path is reconveyed to the first conveying path; a reverse conveyance roller pair, which performs forward rotation to convey the sheet conveyed from the first conveying path, and thereafter performs reverse rotation to convey the sheet to the second conveying path; a reconveying roller pair which is disposed in the second conveying path and which reconveys the sheet, which is conveyed through the reverse rotation of the reverse conveyance roller pair, to the first conveying path; and a control portion which causes the reconveying roller pair to nip, in an overlaid manner, a preceding sheet and a succeeding sheet that is conveyed successively to the preceding sheet by the reverse conveyance roller pair, and thereafter rotates a first roller of the reconveying roller pair that is in contact with the preceding sheet while stopping rotation of a second roller of the reconveying roller pair that is in contact with the succeeding sheet so that the preceding sheet is conveyed to the first conveying path and the succeeding sheet stays in the second conveying path.

According to the present invention, it is possible to provide a sheet conveying apparatus and an image forming apparatus which are capable of enhancing productivity with a simple structure.

Further features of the present invention will become apparent from the following description of exemplary embodiments with reference to the attached drawings.

DESCRIPTION OF EMBODIMENTS

Hereinbelow, referring to the attached drawings, a sheet conveying apparatus and an image forming apparatus according to exemplary embodiments of the present invention will be described. The image forming apparatus according to the exemplary embodiments of the present invention is an image forming apparatus having a duplex printing function capable of performing printing on both sides of a sheet, such as a copying machine, a printer, a facsimile machine, and a multifunction machine of the above-mentioned products. Further, the image forming apparatus includes the sheet conveying apparatus capable of conveying a sheet while being reversed in the image forming apparatus. In the following exemplary embodiments, description is given by taking a laser beam printer as the image forming apparatus.

First Embodiment

Figure 1:
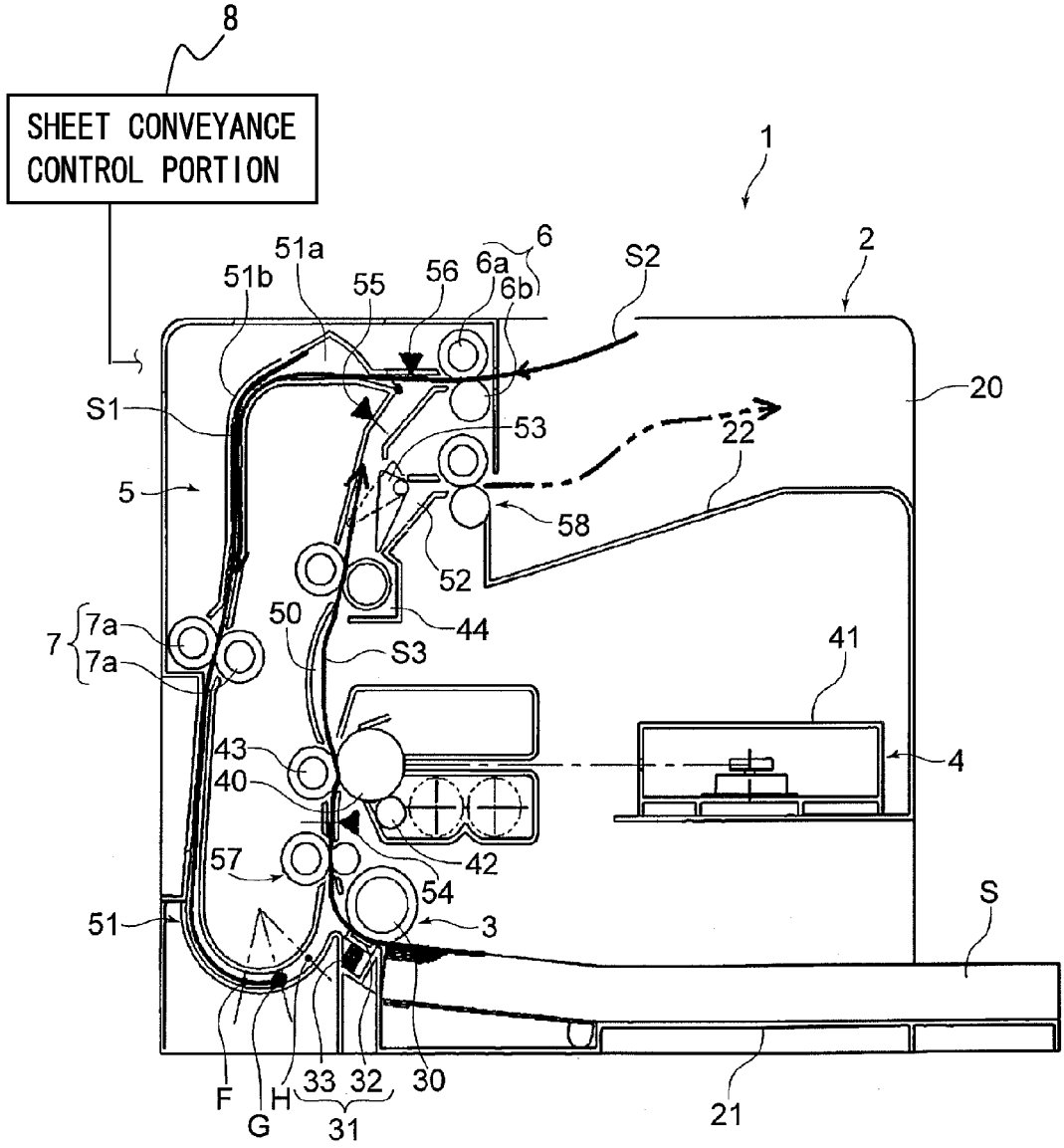
FIG. 1 is a sectional view schematically illustrating an overall structure of a laser beam printer according to a first embodiment of the present invention.
Figure 2:
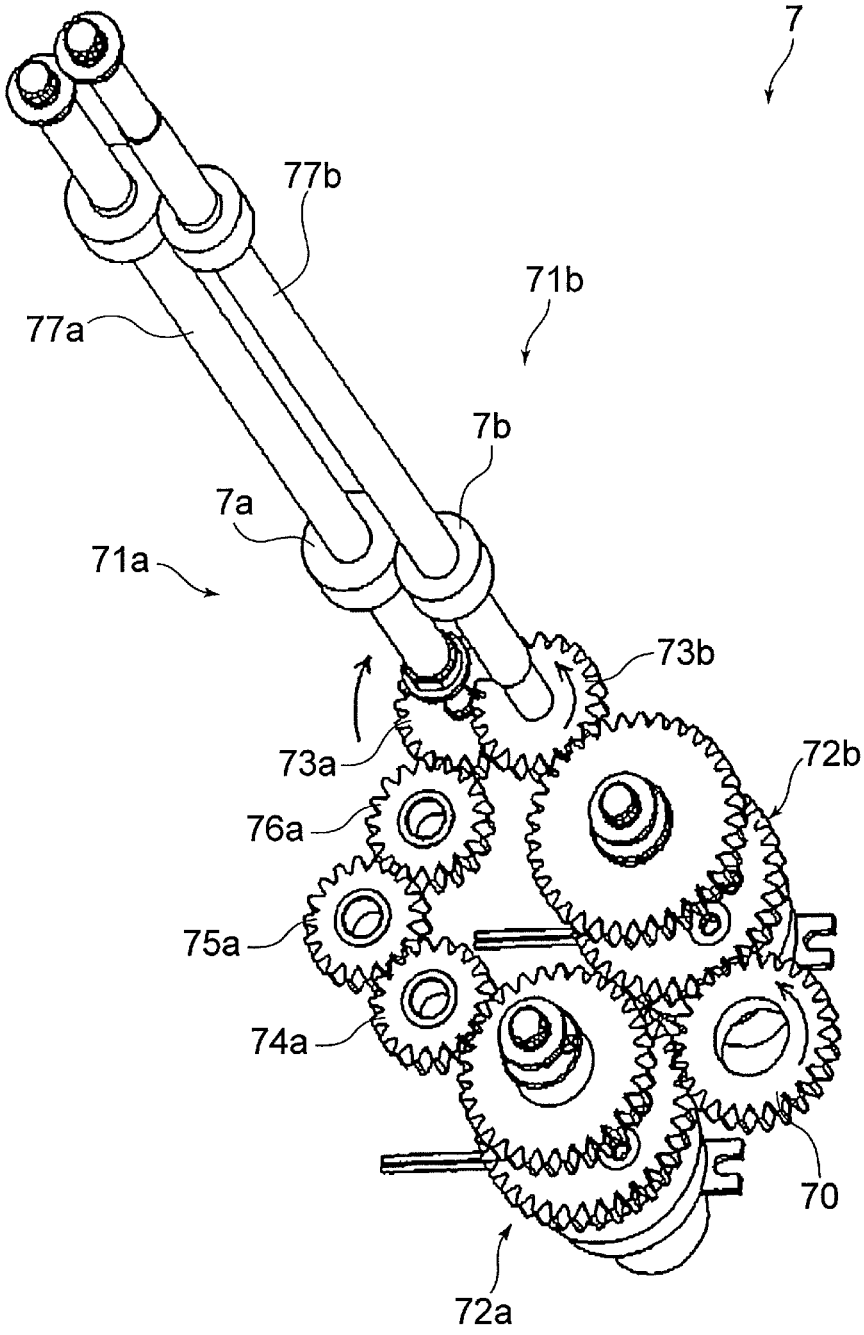
FIG. 2 is a perspective view of a reconveying roller pair according to the first embodiment.
Figure 3:
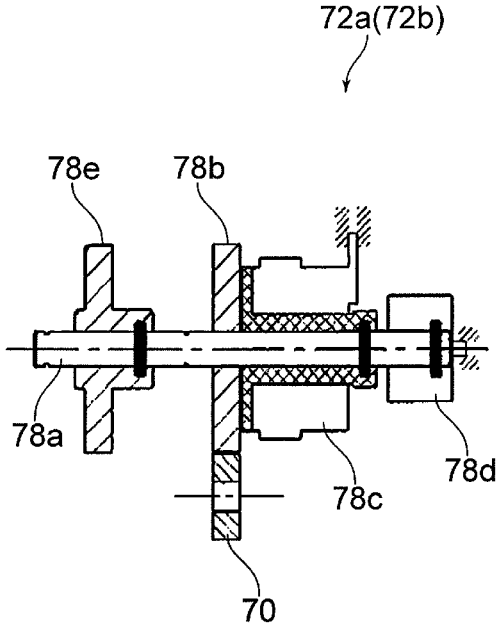
FIG. 3 is a sectional view of a drive unit of the reconveying roller pair illustrated in FIG. 2.
Figure 4A:
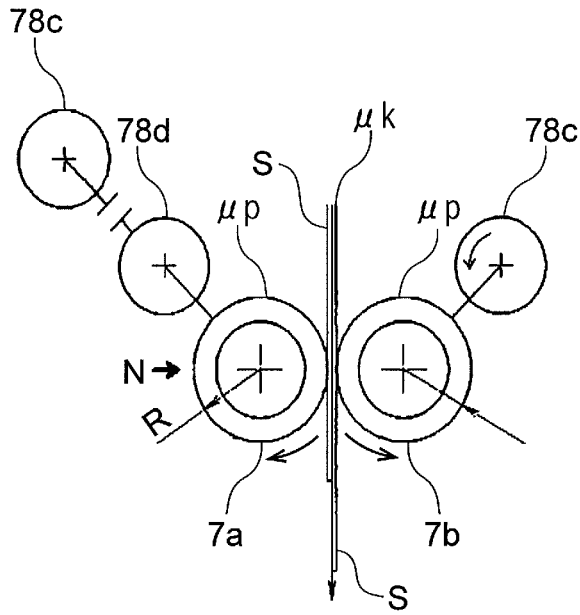
FIG. 4A is a view illustrating a state in which one of two sheets nipped by the reconveying roller pair is conveyed.
Figure 4B:
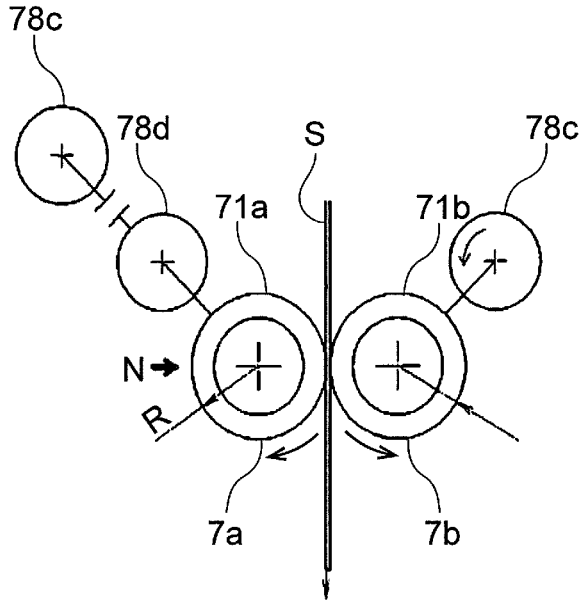
FIG. 4B is a view illustrating a state in which one sheet nipped by the reconveying roller pair is conveyed.

Referring to FIGS. 1 to 4B, a laser beam printer 1 according to a first embodiment of the present invention will be described. FIG. 1 is a sectional view schematically illustrating an overall structure of the laser beam printer 1 according to the first embodiment of the present invention. FIG. 2 is a perspective view of a reconveying roller pair 7 according to the first embodiment. FIG. 3 is a sectional view of a drive unit of the reconveying roller pair 7 illustrated in FIG. 2. FIG. 4A is a view illustrating a state in which one of two sheets S nipped by the reconveying roller pair 7 is conveyed. FIG. 4B is a view illustrating a state in which one sheet S nipped by the reconveying roller pair 7 is conveyed.

First, referring to FIG. 1, the overall structure of the laser beam printer 1 according to the first embodiment will be described. As illustrated in FIG. 1, the laser beam printer 1 according to the first embodiment includes a printer main body 2, a sheet feeding portion 3, an image forming portion 4, a sheet conveying portion 5 serving as the sheet conveying apparatus, and a sheet conveyance control portion 8.

The printer main body 2 forms an appearance of the laser beam printer 1. The printer main body 2 includes a housing 20 for housing the sheet feeding portion 3, the image forming portion 4, and the sheet conveying portion 5 inside the housing 20, a sheet feeding cassette 21 detachably mounted to a lower part of the housing 20, and a sheet discharge tray 22 formed in an upper part of the housing 20. The sheet feeding cassette 21 contains the sheets S stacked one on top of another. The sheet discharge tray 22 receives a sheet that has undergone duplex printing.

The sheet feeding portion 3 includes a feeding roller 30 which feeds the sheets S contained in the sheet feeding cassette 21 to the sheet conveying portion 5, and a separation portion 31 which separates the sheets together with the feeding roller 30. The separation portion 31 includes a separation pad 32, which is brought into pressure contact with the feeding roller 30 to separate sheets one by one, and a separation holder 33 which holds the separation pad 32. The sheet feeding portion 3 uses the separation pad 32 to separate the sheets S contained in the sheet feeding cassette 21 one by one, and meanwhile, uses the feeding roller 30 to feed the separated sheet S to the sheet conveying portion 5.

The image forming portion 4 forms an image on the sheet S based on predetermined image information. The image forming portion 4 includes a photosensitive drum 40, a laser scanner unit 41, a developing portion 42, a transfer roller 43, and a fixing portion 44. The laser scanner unit 41 irradiates the photosensitive drum 40 with information light formed based on the image information. The developing portion 42 develops an electrostatic latent image formed on the photosensitive drum 40. The transfer roller 43 transfers the developed image onto the sheet S. The fixing portion 44 fixes the transferred image onto the sheet S.

The sheet conveying portion 5 includes a first conveying path 50, a second conveying path 51, a sheet discharging path 52, a switching member 53, a first sensor 54, a second sensor 55, a third sensor 56, a conveying roller pair 57, a sheet discharging roller pair 58, a reverse conveyance roller pair 6, and the reconveying roller pair 7.

The first conveying path 50 is a conveying path which conveys the sheet S such as a blank sheet and a sheet printed on one side. The first conveying path 50 is divided into two branches on its upstream side in a conveyance direction of the sheet S. The first conveying path 50 divided into two branches is connected on one side to the sheet feeding cassette 21. The sheet conveyed from the sheet feeding cassette 21 undergoes one-side printing by the image forming portion 4 while the sheet is being conveyed along the first conveying path 50. The first conveying path 50 is also divided into two branches on its downstream side. The first conveying path 50 divided into two branches on the downstream side is formed on one side toward the sheet discharge tray 22.

The second conveying path 51 is a conveying path which reconveys the sheet S having an image printed on one side of the sheet S to the first conveying path 50. The second conveying path 51 is connected on its upstream side to the other side of the first conveying path 50 that is divided into two branches on the downstream side of the first conveying path 50. On the other hand, the second conveying path 51 is connected on its downstream side to the other side of the first conveying path 50 that is divided into two branches on the upstream side of the first conveying path 50.

Further, the second conveying path 51 includes a trailing edge retreat portion 51*a*. The trailing edge retreat portion 51*a* is provided on the upstream side of the second conveying path 51 (between a connecting portion to the first conveying path 50 and a bent portion 51*b* of the second conveying path 51). The trailing edge retreat portion 51*a* is formed so as to be capable of retreating a trailing edge of the sheet S when the sheet S stands by in a stopped state at a predetermined position in the second conveying path 51.

The sheet discharging path 52 is a conveying path which conveys the sheet S that has undergone the duplex printing to the sheet discharge tray 22. The sheet discharging path 52 is connected to the first conveying path 50 on an upstream side of the sheet discharging path 52 in a sheet discharging direction of the sheet S. Specifically, the sheet discharging path 52 is connected to the first conveying path 50 on a downstream side of the image forming portion 4. The sheet discharging path 52 is connected to the sheet discharge tray 22 on a downstream side of the sheet discharging path 52 in the sheet discharging direction. The switching member 53 is attached to a connecting portion between the first conveying path 50 and the sheet discharging path 52. The switching member 53 switches the conveyance direction of the sheet S from the first conveying path 50 to the sheet discharging path 52 to convey the sheet S that has undergone the duplex printing to the sheet discharge tray 22.

The first sensor 54 is arranged on the first conveying path 50 between the sheet feeding portion 3 and the image forming portion 4. The first sensor 54 detects that the sheet S passes through the first conveying path 50 between the sheet feeding portion 3 and the image forming portion 4. The second sensor 55 is arranged on the downstream side of the first conveying path 50 (on the downstream side of the switching member 53). The second sensor 55 detects that the sheet S passes through the first conveying path 50 on the downstream side of the switching member 53. The third sensor 56 is arranged at an access port of the second conveying path 51 (at the connecting portion to the first conveying path 50). The third sensor 56 detects that a reversed sheet S is conveyed to the second conveying path 51.

The conveying roller pair 57 is arranged on the first conveying path 50, and conveys, along the first conveying path 50, the sheet S that is fed or conveyed to the first conveying path 50. The sheet discharging roller pair 58 is arranged on the sheet discharging path 52, and conveys, to the sheet discharge tray 22, the sheet S that is conveyed by the switching member 53 from the first conveying path 50 to the sheet discharging path 52.

The reverse conveyance roller pair 6 is arranged on one side (sheet discharge tray 22 side) of the first conveying path 50 that is divided into two branches on the downstream side. The reverse conveyance roller pair 6 performs forward rotation to convey the sheet S from the first conveying path 50, and performs reverse rotation to reverse the conveyed sheet S. Specifically, the reverse conveyance roller pair 6 performs forward rotation to convey the sheet S, which is conveyed from the first conveying path 50, to the one side (sheet discharge tray 22 side) of the first conveying path 50 that is divided into two branches, and then performs reverse rotation to convey the sheet S to the second conveying path 51. In this manner, the printing surface of the sheet S is reversed when the sheet S is reconveyed to the first conveying path 50. Note that, in the first embodiment, the reverse conveyance roller pair 6 includes an independently rotatable first reverse conveyance roller 6*a*, and a rotatable member 6*b* provided so as to be freely brought into contact with and separated from the first reverse conveyance roller 6*a*.

The reconveying roller pair 7 is arranged on the second conveying path 51, and conveys the sheet S that is conveyed to the second conveying path 51. Further, the reconveying roller pair 7 includes a first reconveying roller 7*a* and a second reconveying roller 7*b*, and is formed so as to be capable of nipping two sheets between the first reconveying roller 7*a* and the second reconveying roller 7*b* at the same time. The first reconveying roller 7*a* and the second reconveying roller 7*b* are rotatable independently of each other.

Now, referring to FIGS. 2 and 3, a structure of a rotation mechanism of the reconveying roller pair 7 including the independently rotatable first reconveying roller 7*a* and second reconveying roller 7*b* will be described. As illustrated in FIGS. 2 and 3, the reconveying roller pair 7 includes an input gear 70, a first reconveying unit 71*a*, and a second reconveying unit 71*b*.

The input gear 70 transmits a drive force from a power source (not shown) to the first reconveying unit 71*a* and the second reconveying unit 71*b*. The first reconveying unit 71*a* includes a first drive unit 72*a*, a first drive gear 73*a*, idler gears 74*a*, 75*a*, and 76*a*, the first reconveying roller 7*a*, and a roller rotation shaft 77*a*.

As illustrated in FIG. 3, the first drive unit 72*a* includes a rotation shaft 78*a*, a clutch gear 78*b*, an electromagnetic clutch 78*c*, a torque limiter 78*d*, and an output gear 78*e*. The clutch gear 78*b* meshes with the input gear 70, and transmits the drive force from the input gear 70. The electromagnetic clutch 78*c* is attached to the rotation shaft 78*a*, and transmits the drive force, which is transmitted from the clutch gear 78*b*, to the rotation shaft 78*a* or cuts off the drive force. Note that, the clutch gear 78*b* is rotatably attached to the rotation shaft 78*a*, and in a state in which the electromagnetic clutch 78*c* is not actuated, the drive force from the input gear 70 is not transmitted to the rotation shaft 78*a*. On the other hand, when the electromagnetic clutch 78*c* is actuated, the clutch gear 78*b* meshes with a rotor of the electromagnetic clutch 78*c* to rotate the rotation shaft 78*a* against a braking force of the torque limiter 78*d*.

When the drive force is cut off by the electromagnetic clutch 78*c*, the torque limiter 78*d* brakes the rotation shaft 78*a* to prevent idle rotation. The output gear 78*e* is attached to the rotation shaft 78*a*, and meshes with the idler gears 74*a*, 75*a*, and 76*a*. The output gear 78*e* transmits the drive force, which is transmitted from the rotation shaft 78*a*, to the idler gears 74*a*, 75*a*, and 76*a*.

The idler gears 74*a*, 75*a*, and 76*a* mesh with the first drive gear 73*a*, and transmits the drive force, which is transmitted from the output gear 78*e*, to the first drive gear 73*a*. The first drive gear 73*a* is fixed to the roller rotation shaft 77*a*, and rotates the roller rotation shaft 77*a* by the drive force transmitted from the idler gears 74*a*, 75*a*, and 76*a*. The first reconveying roller 7*a* is fixed to the roller rotation shaft 77*a*, and rotates through the rotation of the roller rotation shaft 77*a*. Further, the surface of the first reconveying roller 7*a* has such a coefficient of friction that the frictional force is larger between the first reconveying roller 7*a* and the sheet S than between the two sheets S to be conveyed.

The second reconveying unit 71*b* includes a second drive unit 72*b*, a second drive gear 73*b*, and a roller rotation shaft 77*b*. The second reconveying unit 71*b* is different from the first reconveying unit 71*a* in that the second reconveying unit 71*b* does not include the idler gears 74*a*, 75*a*, and 76*a*, but other components of the second reconveying unit 71*b* are the same as those of the first reconveying unit 71*a*. Therefore, the description of the first reconveying unit 71*a* is used for a description of the second reconveying unit 71*b*, so that the description of the second reconveying unit 71*b* is omitted. Components of the second drive unit 72*b* of the second reconveying unit 71*b* are the same as those of the first drive unit 72*a* (FIG. 3), and description thereof is therefore omitted herein.

Next, referring to FIGS. 4A and 4B, conditions for conveying the sheets S by the reconveying roller pair 7 including the independently rotatable first reconveying roller 7*a* and second reconveying roller 7*b* will be described.

In FIGS. 4A and 4B, it is assumed that "μp" is a coefficient of friction between one of the sheets S to be conveyed and the first reconveying roller 7*a* or the second reconveying roller 7*b*, "μk" is a coefficient of friction between the sheets S to be conveyed, and "R" is a radius of each of the first reconveying roller 7*a* and the second reconveying roller 7*b*. Further, it is assumed that "T" is a braking torque on the roller rotation shaft 77*a*, and "N" is a pressurizing force acting between the first reconveying roller 7*a* and the second reconveying roller 7*b*. Then, the braking torque T of each of the first reconveying roller 7*a* and the second reconveying roller 7*b* in the reconveying roller pair 7 nipping two sheets as shown in FIG. 4A may be expressed as follows:

$$N \cdot \mu k \leq T/R \quad (1)$$

As expressed by the expression (1), when the frictional force between one of the overlaid two sheets S and the roller abutting against the sheet S is larger than the frictional force between the sheets S, the sheet S abutting against the roller can be conveyed by the frictional force between the sheet S and the roller, against the frictional force between the sheets S. Similarly, when the roller abutting against the other one of the sheets S is stopped, the sheet S can maintain the stopped state by the frictional force between the sheet S and the roller, against the frictional force between the sheets S. In other words, by rotating one or both of the first reconveying roller 7*a* and the second reconveying roller 7*b*, the sheet S abutting against the first reconveying roller 7*a* and the sheet S abutting against the second reconveying roller 7*b* can be conveyed selectively.

Further, the braking torque T of each of the first reconveying roller 7*a* and the second reconveying roller 7*b* in the reconveying roller pair 7 nipping one sheet S as shown in FIG. 4B may be expressed as follows:

$$T/R < N \cdot \mu p \quad (2)$$

As expressed by the expression (2), when the force between the sheet S and the roller abutting against the sheet S is larger than the braking torque of the roller, the sheet S can be conveyed selectively by rotating the roller.

The sheet conveyance control portion 8 controls the drive of the switching member 53, the conveying roller pair 57, the sheet discharging roller pair 58, the reverse conveyance roller pair 6, and the reconveying roller pair 7. Further, the sheet conveyance control portion 8 independently controls the rotation of the first reconveying roller 7*a* and the second reconveying roller 7*b* of the reconveying roller pair 7. The sheet conveyance control portion 8 rotates one or both of the first reconveying roller 7*a* and the second reconveying roller 7*b* to selectively convey one or both of the sheet S abutting against the first reconveying roller 7*a* and the sheet S abutting against the second reconveying roller 7*b*.

Next, referring to FIGS. 5A to 7B as well as FIG. 1, an operation of conveying the sheets S at the start of the duplex printing of the laser beam printer 1 according to the first embodiment will be described. Note that, in the following, the sheet that is firstly conveyed (preceding sheet) is referred to as "first sheet S1"; the succeeding sheet, that is secondly conveyed (succeeding sheet that is conveyed successively to the preceding sheet), is referred to as "second sheet S2"; the sheet, that is thirdly conveyed, is referred to as "third sheet S3"; and the sheet, that is fourthly conveyed, is referred to as "fourth sheet".

Further, the sheet conveyance control portion 8 controls the drive of the switching member 53, the conveying roller pair 57, the sheet discharging roller pair 58, the reverse conveyance roller pair 6, and the reconveying roller pair 7 (first reconveying roller 7*a* and second reconveying roller 7*b*), and the following description is directed mainly to the respective components.

Figure 5A:
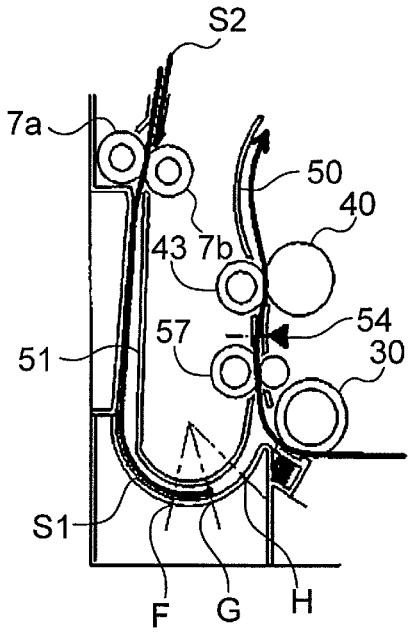
FIG. 5A is a view illustrating a state in which a first sheet stands by at a first position in a second conveying path.
Figure 5B:
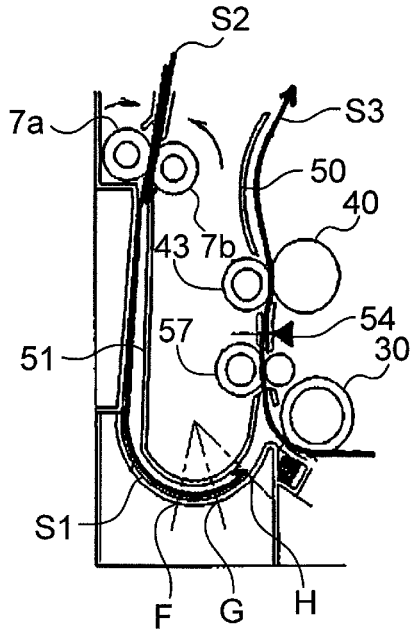
FIG. 5B is a view illustrating a state in which the reconveying roller pair is rotated so that the first sheet stands by at a second position and a second sheet and the first sheet are nipped by the reconveying roller pair.
Figure 6A:
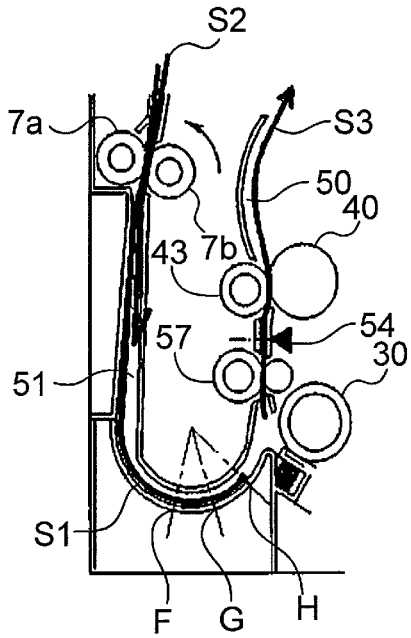
FIG. 6A is a view illustrating a state in which a second reconveying roller is rotated so that the second sheet is conveyed with the first sheet standing by at the second position.
Figure 6B:
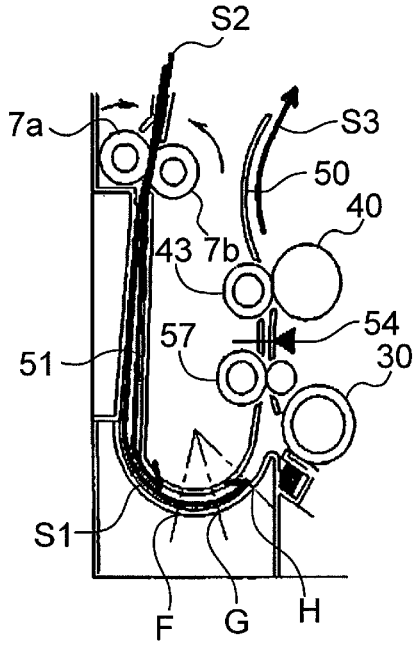
FIG. 6B is a view illustrating a state in which the second sheet is conveyed to a third position with the first sheet standing by at the second position.
Figure 7A:
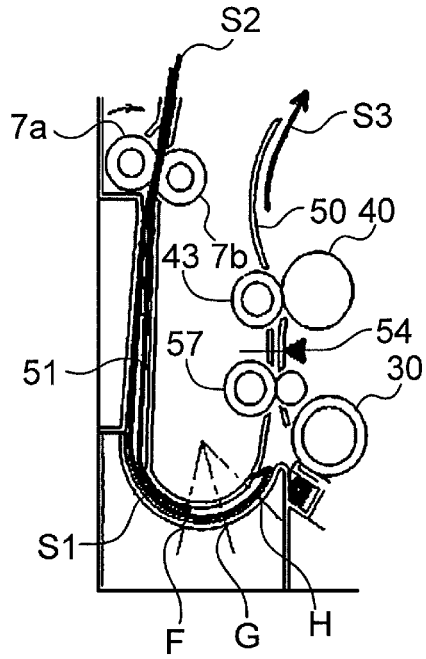
FIG. 7A is a view illustrating a state in which a first reconveying roller is rotated so that the first sheet is conveyed with the second sheet standing by at the third position.
Figure 7B:
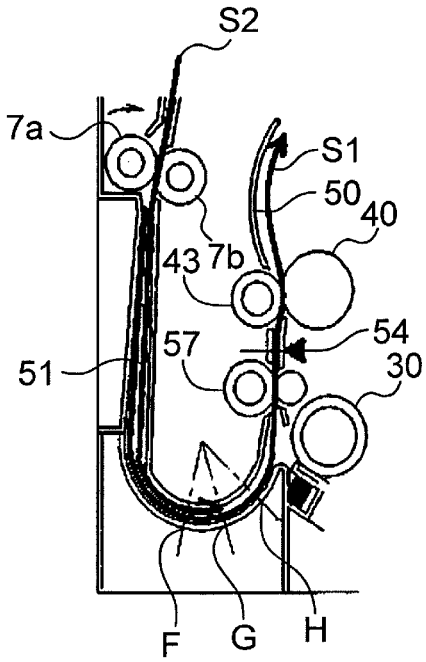
FIG. 7B is a view illustrating a state in which the first sheet having images formed on both sides is conveyed and the second sheet is moved to the first position.

FIG. 5A is a view illustrating a state in which the first sheet S1 stands by at a first position G in the second conveying path 51. FIG. 5B is a view illustrating a state in which the reconveying roller pair 7 is driven so that the first sheet S1 stands by at a second position H and the second sheet S2 is nipped while being overlaid on the first sheet S1. FIG. 6A is a view illustrating a state in which the second reconveying roller 7*b* is rotated so that the second sheet S2 is conveyed with the first sheet S1 standing by at the second position H. FIG. 6B is a view illustrating a state in which the second sheet S2 is conveyed to a third position F with the first sheet S1 standing by at the second position H. FIG. 7A is a view illustrating a state in which the first reconveying roller 7*a* is rotated so that the first sheet S1 is conveyed with the second sheet S2 standing by at the third position F. FIG. 7B is a view illustrating a state in which the first sheet S1 having images formed on both sides of the first sheet S1 is conveyed and the second sheet S2 is moved to the first position G.

When the duplex printing is started, the first sheet S1 is fed from the sheet feeding cassette 21 to the first conveying path 50, and an image is formed on the first side of the first sheet S1 by the image forming portion 4. The first sheet S1 having the image formed on the first side of the first sheet S1 is conveyed toward the downstream side of the first conveying path 50 by the conveying roller pair 57 without being conveyed to the sheet discharging path 52 by the switching member 53.

When the first sheet S1 is conveyed to the downstream side of the first conveying path 50, the first sheet S1 is conveyed, to one side (sheet discharge tray 22 side) of the first conveying path 50 that is divided into two branches on the downstream side, by the reverse conveyance roller pair 6 arranged on the downstream side of the first conveying path 50. The trailing edge of the first sheet S1 conveyed to the sheet discharge tray 22 side by the reverse conveyance roller pair 6 passes through the second sensor 55, and when a predetermined period of time has elapsed since then, the trailing edge of the first sheet S1 passes through a branch point E of the first conveying path 50. When the trailing edge of the first sheet S1 passes through the branch point E due to the lapse of the predetermined period of time, the reverse conveyance roller pair 6 starts reverse rotation. When the reverse conveyance roller pair 6 performs reverse rotation, the first sheet S1 is conveyed to the second conveying path 51.

When the first sheet S1 is nipped by the reconveying roller pair 7 in the second conveying path 51, the rotatable member 6*b* of the reverse conveyance roller pair 6 is separated from the first reverse conveyance roller 6*a*, and the first reverse conveyance roller 6*a* stops the rotation. When the rotatable member 6*b* is separated from the first reverse conveyance roller 6*a*, a clearance is formed between the first reverse conveyance roller 6*a* and the rotatable member 6*b*. Note that, at this time, the trailing edge side of the first sheet S1 is situated (in a clearance) between the first reverse conveyance roller 6*a* and the rotatable member 6*b*.

Meanwhile, the second sheet S2 succeeding the first sheet S1 reaches the reverse conveyance roller pair 6 in the same manner as the first sheet S1 after performing the same operation as the first sheet S1. At this time, the clearance is formed between the first reverse conveyance roller 6*a* and the rotatable member 6*b*. Therefore, the second sheet S2 that has reached the reverse conveyance roller pair 6 is conveyed to the sheet discharge tray 22 side in such a manner that the second sheet S2 and the first sheet S1 pass each other.

When the trailing edge of the first sheet S1 conveyed by the reconveying roller pair 7 passes through the third sensor 56, the rotatable member 6*b* that is separated from the first reverse conveyance roller 6*a* moves toward the first reverse conveyance roller 6*a*, and the rotatable member 6*b* and the first reverse conveyance roller 6*a* nip the second sheet S2 therebetween. When the reverse conveyance roller pair 6 nips the second sheet S2, the first reverse conveyance roller 6*a* performs forward rotation to further convey the second sheet S2 to the sheet discharge tray 22 side. The trailing edge of the second sheet S2 conveyed by the reverse conveyance roller pair 6 passes through the second sensor 55, and when a predetermined period of time has elapsed since then, the trailing edge of the second sheet S2 passes through the branch point E of the first conveying path 50. When the second sheet S2 passes through the branch point E due to the lapse of the predetermined period of time, the reverse conveyance roller pair 6 starts reverse rotation. When the reverse conveyance roller pair 6 performs reverse rotation, the second sheet S2 is conveyed to the second conveying path 51 in a reversed state. At this time, in order to reduce the printing interval, the third sheet S3 succeeding the second sheet S2 is further fed to the first conveying path 50.

As illustrated in FIG. 5A, when the leading edge of the first sheet S1 has reached the first position G in the second conveying path 51, the electromagnetic clutches 78*c* of the reconveying roller pair 7 cut off the drive force. In this case, the electromagnetic clutches 78*c* of both the first drive unit 72*a* and the second drive unit 72*b* cut off the drive. When the drive force is cut off, the reconveying roller pair 7 is stopped by the torque limiter 78*d* so that the first sheet S1 enters a state of standing by at the first position G. At this time, as illustrated in FIG. 1, the trailing edge of the first sheet S1 retreats to the trailing edge retreat portion 51*a* by the stiffness of the first sheet S1 (force of recovering the planar shape).

After the reconveying roller pair 7 is stopped in the state of nipping the first sheet S1, the second sheet S2 is conveyed to the second conveying path 51 by the reverse conveyance roller pair 6. At this time, the second sheet S2 is conveyed along the second conveying path 51 while being overlaid on the first sheet S1, but the trailing edge of the first sheet S1 retreats to the trailing edge retreat portion 51*a*, and accordingly the second sheet S2 is conveyed while being overlaid on the first sheet S1 without hitting against the first sheet S1.

As illustrated in FIG. 5B, when the leading edge of the second sheet S2 has reached the reconveying roller pair 7, the electromagnetic clutches 78*c* are actuated so that the reconveying roller pair 7 starts rotation. Specifically, the electromagnetic clutches 78*c* of both the first reconveying unit 71*a* and the second reconveying unit 71*b* are actuated so that the rotational drive force is transmitted to both the first reconveying roller 7*a* and the second reconveying roller 7*b*. When the reconveying roller pair 7 rotates, the second sheet S2 enters the reconveying roller pair 7, and the first sheet S1 and the second sheet S2 are nipped by the reconveying roller pair 7 while being overlaid one on another. After the second sheet S2 is nipped by the reconveying roller pair 7, the rotatable member 6*b* is separated from the first reverse conveyance roller 6*a*.

As illustrated in FIG. 6A, when the leading edge of the first sheet S1 has reached the second position H, the electromagnetic clutch 78*c* of the first reconveying unit 71*a* including the first reconveying roller 7*a* abutting against the first sheet S1 is disconnected so that the first sheet S1 is stopped at the second position H. Meanwhile, the electromagnetic clutch 78*c* of the second reconveying unit 71*b* for transmitting the drive to the second reconveying roller 7*b* is maintained in the state of transmitting the drive. Accordingly, the second reconveying unit 71*b* including the second reconveying roller 7*b* abutting against the second sheet S2 conveys the second sheet S2. When the second sheet S2 is conveyed by the second reconveying roller 7*b* while being overlaid on the first sheet S1, the trailing edge side of the second sheet S2 is situated (in a clearance) between the first reverse conveyance roller 6*a* and the rotatable member 6*b* separated from the first reverse conveyance roller 6*a*. The trailing edge side of the second sheet S2 and the leading edge side of the third sheet S3 is passed each other between the first reverse conveyance roller 6*a* and the rotatable member 6*b*. When the second sheet S2 is conveyed by the second reconveying roller 7*b*, the third sheet S2 succeeding the second sheet S2 reaches the reverse conveyance roller pair 6. Therefore, the third sheet S3 that has reached the reverse conveyance roller pair 6 is conveyed toward the sheet discharge tray 22 in such a manner that the third sheet S3 and the second sheet S2 pass each other in the clearance between the first reverse conveyance roller 6*a* and the rotatable member 6*b*.

Subsequently, as illustrated in FIG. 6B, when the second sheet S2 has reached the third position F, the electromagnetic clutch 78*c* of the second reconveying unit 71*b* is disconnected so that the second sheet S2 is stopped at the third position F.

When the first sensor 54 detects the passage of the trailing edge of the third sheet S3 that is fed successively to the second sheet S2, as illustrated in FIG. 7A, the electromagnetic clutch 78*c* of the first reconveying unit 71*a* is actuated (connected) so that the first reconveying roller 7*a* rotates. When the first reconveying roller 7*a* rotates, the first sheet S1 abutting against the first reconveying roller is conveyed toward the image forming portion 4, and an image is formed on the second side of the first sheet S1. At this time, the second sheet S2 abutting against the second reconveying roller 7*b* stands by in the stopped state without being moved in association with the movement of the first sheet S1.

As illustrated in FIG. 7B, when the trailing edge of the first sheet S1 exits the reconveying roller pair 7, the electromagnetic clutch 78*c* of the second reconveying unit 71*b* is actuated (connected) so that the second sheet S2 is conveyed again. When the leading edge of the second sheet S2 has reached the first position G, the electromagnetic clutch 78*c* of the second reconveying unit 71*b* is disconnected so that the second sheet S2 is stopped at the first position G.

When the first sheet S1 reconveyed to the first conveying path 50 has undergone the image formation for the second side of the first sheet S1 in the image forming portion 4, the conveyance direction of the first sheet S1 is switched from the first conveying path 50 to the sheet discharging path 52 by the switching member 53, and the first sheet S1 is conveyed to the sheet discharge tray 22.

The third sheet S3 that has undergone the one-side printing is reversed by the reverse conveyance roller pair 6, and then, through the same operation as described above, the third sheet S3 is nipped by the reconveying roller pair 7, which is nipping the second sheet S2. When the third sheet S3 enters the reconveying roller pair 7, the second sheet S2 moves to the second position H. When the one-side printing is started for the fourth sheet, which is fed from the sheet feeding cassette 21, along with the end of the printing for the second side of the first sheet S1, the second sheet S2 moves to and stands by at the second position H. Similarly, the third sheet S3 moves to and stands by at the first position G.

In the manner as described above, the laser beam printer 1 first performs one-side printing on three sheets in an order of, for example, the first side of the first sheet S1, the first side of the second sheet S2, and the first side of the third sheet S3. After that, the laser beam printer 1 alternately repeats reconveyance of the sheet that has undergone the one-side printing and feeding of the blank sheet in an order of, for example, the second side of the first sheet S1, the first side of the fourth sheet, and the second side of the second sheet S2. Thus, the duplex printing is enabled with the same printing interval as that of the one-side printing.

The laser beam printer 1 according to this embodiment that is structured as described above produces the following effects. In the laser beam printer 1 according to the first embodiment, the reconveying roller pair 7 of the sheet conveying portion 5 is capable of nipping the first sheet S1 and the second sheet S2 at the same time. Further, the first reconveying roller 7*a* and the second reconveying roller 7*b* are rotatable independently of each other. In addition, the first reconveying roller 7*a* and the second reconveying roller 7*b* each have the coefficient of friction that is higher than the coefficient of friction between the first sheet S1 and the second sheet S2 nipped therebetween.

Therefore, for example, in a case where the reconveying roller pair 7 nips the first and second sheets S1 and S2, by rotating one or both of the first and second reconveying rollers 7*a* and 7*b*, one or both of the first and second sheets S1 and S2 can be conveyed selectively. Further, by stopping the rotation of one or both of the first and second reconveying rollers 7*a* and 7*b*, the conveyance of one or both of the first and second sheets S1 and S2 can be stopped selectively. Thus, the first sheet S1 and the second sheet S2 can stand by while being overlaid one on another, which reduces the printing interval. As a result, the laser beam printer 1 including the sheet conveying portion 5 capable of enhancing the productivity in the duplex printing can be provided with the simple structure.

Further, the laser beam printer 1 according to the first embodiment includes, on the upstream side of the second conveying path 51 in the conveyance direction, the trailing edge retreat portion 51*a* capable of retreating the trailing edge of the preceding first sheet S1. Therefore, even in a case where the succeeding second sheet S2 enters the second conveying path 51 with the first sheet S1 standing by on the second conveying path 51, the contact of the leading edge of the second sheet S2 with the trailing edge of the first sheet S1 can be prevented. Thus, the second sheet S2 can enter the second conveying path 51 easily. As a result, the second sheet S2 can be arranged on the second conveying path 51 while being overlaid on the first sheet S1.

Further, the laser beam printer 1 according to the first embodiment includes the plurality of standby positions F, G, and H in the second conveying path 51, at each of which the leading edge of the first sheet S1 is to be placed. Further, the first sheet S1 and the second sheet S2 stand by in the overlaid state. As described above, by providing the standby positions stepwise, the position for reconveyance (second position H) can be fixed irrespective of the size of the sheet. Therefore, there is no need to provide the standby positions preset according to, for example, the largest sheet, which can reduce the unnecessary printing interval that may be created between the first sheet S1 and the second sheet S2.

Second Embodiment

Figure 8:
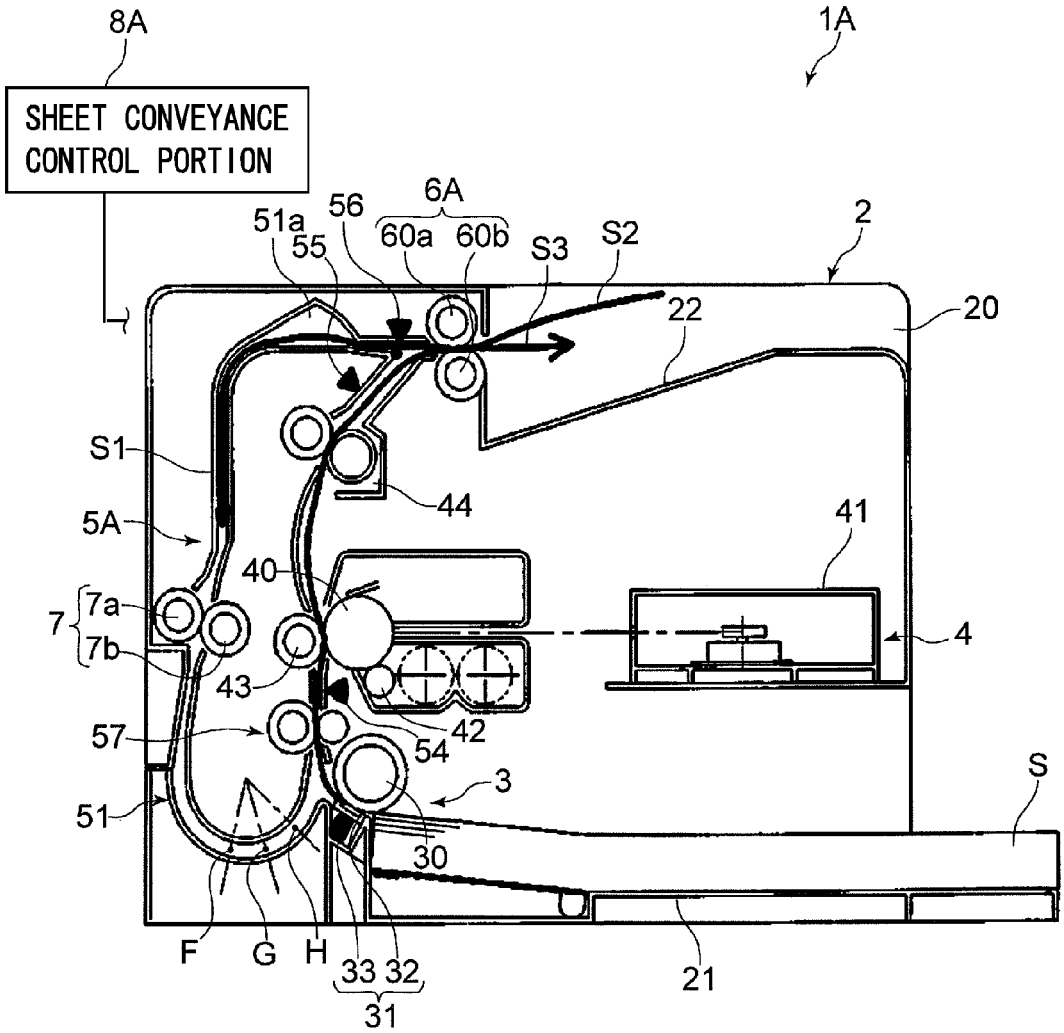
FIG. 8 is a sectional view schematically illustrating an overall structure of a laser beam printer according to a second embodiment of the present invention.
Figure 9:
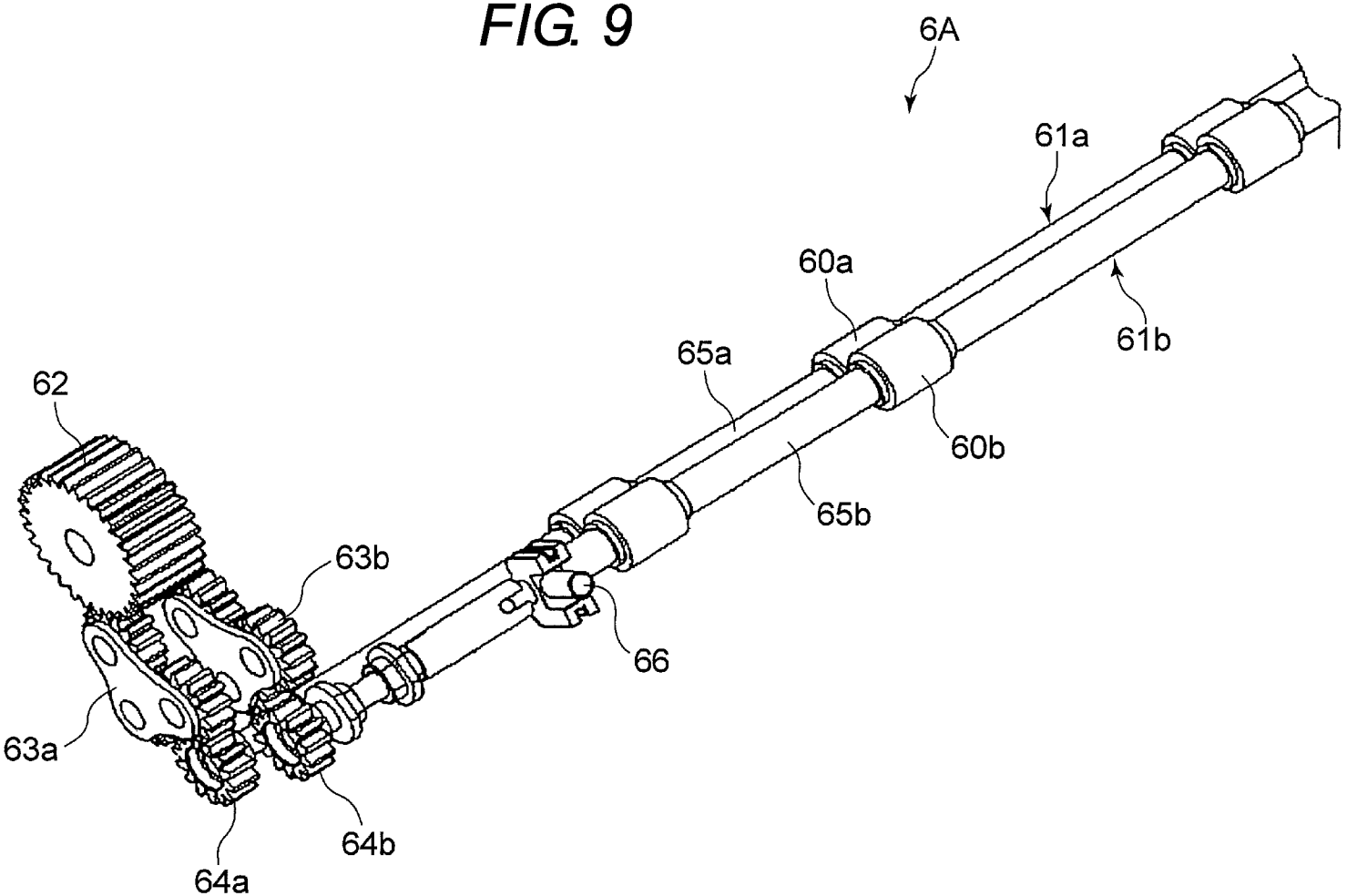
FIG. 9 is a perspective view of a reverse conveyance roller pair according to the second embodiment.
Figure 10A:
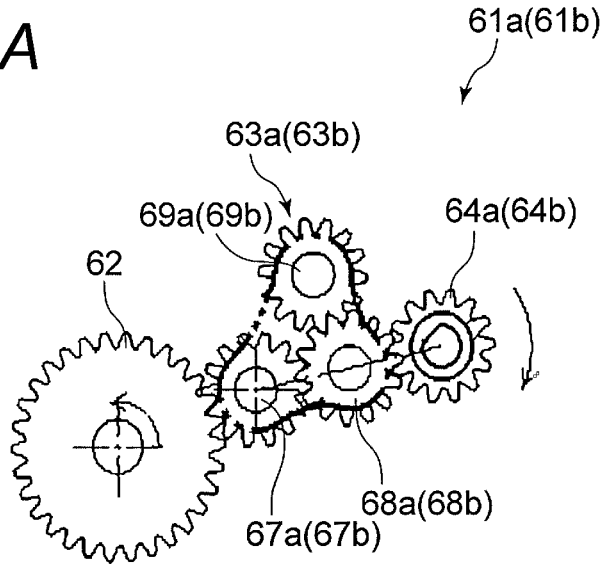
FIG. 10A is a view illustrating a state in which a first drive gear rotates in a direction opposite to that of an input gear by a first switching unit.
Figure 10B:
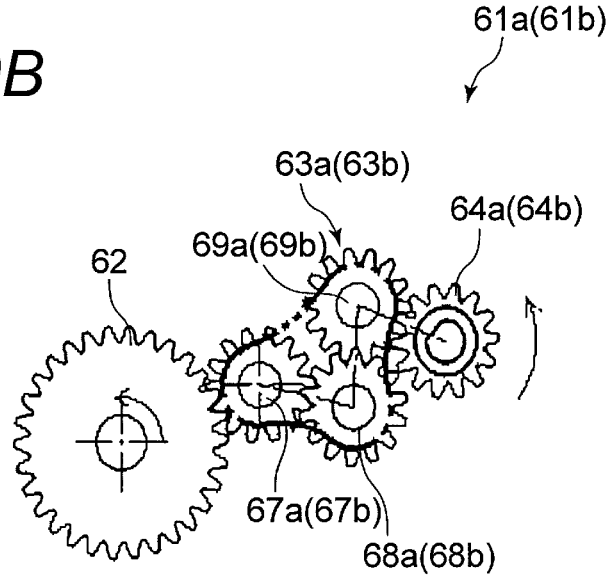
FIG. 10B is a view illustrating a state in which the first drive gear rotates in the same direction as that of the input gear by the first switching unit.

Next, referring to FIGS. 8 to 10B, a laser beam printer 1A according to a second embodiment of the present invention will be described. FIG. 8 is a sectional view schematically illustrating an overall structure of the laser beam printer 1A according to the second embodiment of the present invention. FIG. 9 is a perspective view of a reverse conveyance roller 6A according to the second embodiment. FIG. 10A is a view illustrating a state in which a first drive gear 64*a* rotates in a direction opposite to that of an input gear 62 by a first switching unit 63*a*. FIG. 10B is a view illustrating a state in which the first drive gear 64*a* rotates in the same direction as that of the input gear 62 by the first switching unit 63*a*.

The laser beam printer 1A according to the second embodiment is different from the laser beam printer 1 according to the first embodiment in the reverse conveyance roller pair of the sheet conveying portion. Therefore, in the second embodiment, the difference from the first embodiment, that is, the reverse conveyance roller pair 6A of a sheet conveying portion 5A, will be mainly described.

Note that, in the second embodiment, components having the same structures as those of the laser beam printer 1 according to the first embodiment are denoted by the same reference symbols, and description thereof is omitted herein. Further, in the second embodiment, the components having the same structures as those in the first embodiment produce the same effects as those in the first embodiment.

First, referring to FIG. 8, the overall structure of the laser beam printer 1A according to the second embodiment will be described. As illustrated in FIG. 8, the laser beam printer 1A according to the second embodiment includes a printer main body 2, a sheet feeding portion 3, an image forming portion 4, the sheet conveying portion 5A serving as the sheet conveying apparatus, and a sheet conveyance control portion 8A.

The sheet conveying portion 5A includes a first conveying path 50, a second conveying path 51, a first sensor 54, a second sensor 55, a third sensor 56, a conveying roller pair 57, the reverse conveyance roller pair 6A, and a reconveying roller pair 7.

As illustrated in FIG. 9, the reverse conveyance roller pair 6A includes the input gear 62, a first reverse conveyance unit 61*a*, and a second reverse conveyance unit 61*b*. The input gear 62 transmits a drive force from a power source (not shown) to the first reverse conveyance unit 61*a* and the second reverse conveyance unit 61*b*. The first reverse conveyance unit 61*a* includes the first switching unit 63*a*, the first drive gear 64*a*, a first roller rotation shaft 65*a*, and a first reverse conveyance roller 60*a*. The first switching unit 63*a* meshes with the input gear 62 and the first drive gear 64*a*, and transmits the drive force from the input gear 62 to the first drive gear 64*a*.

Further, the first switching unit 63*a* includes a first gear 67*a* meshing with the input gear 62, a second gear 68*a* meshing with the first gear 67*a*, and a third gear 69*a* meshing with the second gear 68*a*. The first switching unit 63*a* is pivotable about the first gear 67*a* by a rotational portion (not shown) so that the second gear 68*a* or the third gear 69*a* meshes with the first drive gear 64*a*.

For example, as illustrated in FIG. 10A, when the second gear 68*a* meshes with the first drive gear 64*a*, the first drive gear 64*a* rotates in the direction opposite to that of the input gear 62. Further, for example, as illustrated in FIG. 10B, when the first switching unit 63*a* is rotated so that the third gear 69*a* meshes with the first drive gear 64*a*, the first drive gear 64*a* rotates in the same direction as that of the input gear 62. In other words, by rotating the first switching unit 63*a*, the rotation direction of the first drive gear 64*a* can be set independently.

The first drive gear 64*a* is attached to a tip end of the first roller rotation shaft 65*a*. The first drive gear 64*a* rotates the first roller rotation shaft 65*a* by the drive force transmitted from the first switching unit 63*a*.

The first reverse conveyance roller 60*a* is fixed to the first roller rotation shaft 65*a*, and rotates through the rotation of the first roller rotation shaft 65*a*. Further, the first reverse conveyance roller 60*a* has such a coefficient of friction that the frictional force is larger between the first reverse conveyance roller 60*a* and the sheet S than between the sheets S to be conveyed or reversed.

The second reverse conveyance unit 61*b* has the same structure as the first reverse conveyance unit 61*a*. Therefore, the description of the first reverse conveyance unit 61*a* is used for a description of the second reverse conveyance unit 61*b* by replacing the word "first" in the description of the first reverse conveyance unit 61*a* with a word "second", and the description of the second reverse conveyance unit 61*b* is omitted herein.

Note that, the first reverse conveyance unit 61*a* is pressed against the second reverse conveyance unit 61*b* by a compression spring 66, and the first reverse conveyance roller 60*a* is pressed against a second reverse conveyance roller 60*b* of the second reverse conveyance unit 61*b*.

Next, referring to FIGS. 11A to 12B as well as FIG. 8, an operation of conveying the sheets S at the start of the duplex printing of the laser beam printer 1A according to the second embodiment will be described.

Figure 11A:
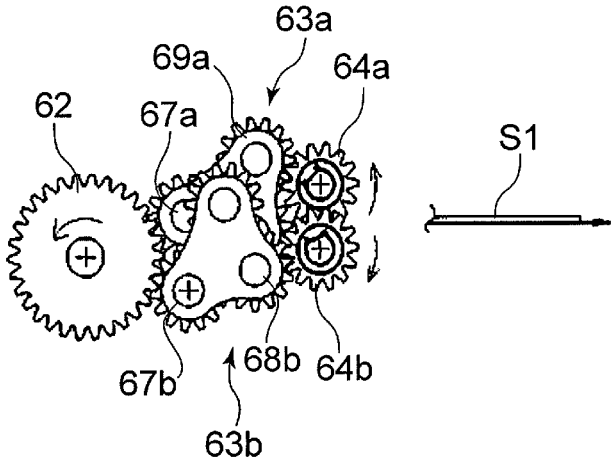
FIG. 11A is a view illustrating a state in which the reverse conveyance roller pair performs forward rotation to convey the first sheet.
Figure 11B:
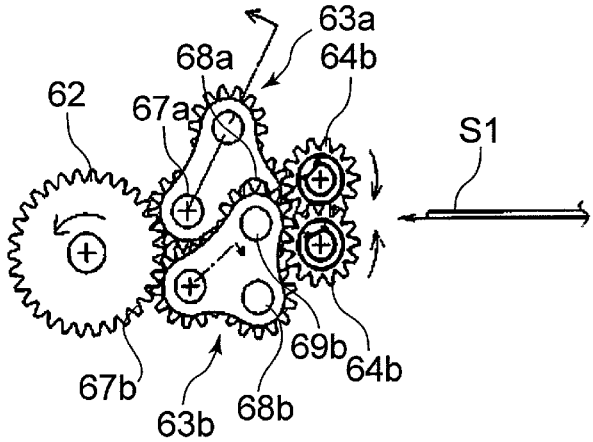
FIG. 11B is a view illustrating a state in which the reverse conveyance roller pair performs reverse rotation to reverse the first sheet.
Figure 12A:
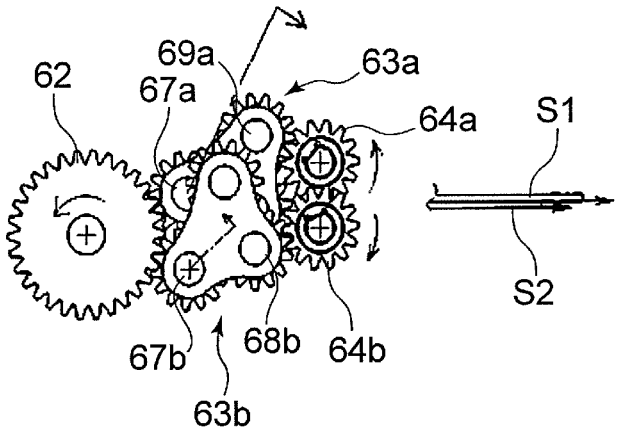
FIG. 12A is a view illustrating a state in which the reverse conveyance roller pair performs forward rotation to convey the first sheet and the second sheet.
Figure 12B:
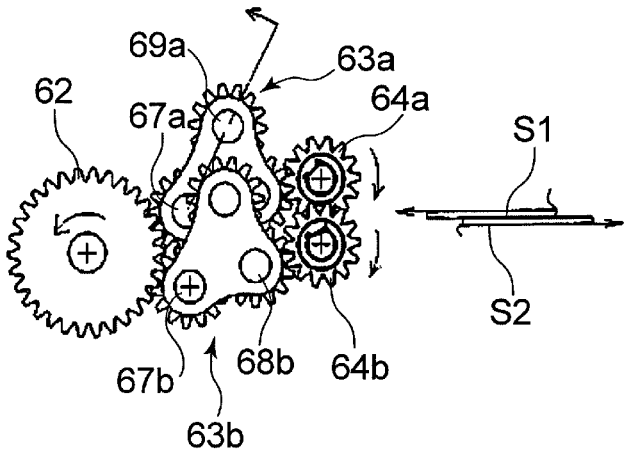
FIG. 12B is a view illustrating a state in which a first reverse conveyance roller of the reverse conveyance roller pair performs reverse rotation to reverse the first sheet, and a second reverse conveyance roller of the reverse conveyance roller pair performs forward rotation to convey the second sheet.

FIG. 11A is a view illustrating a state in which the reverse conveyance roller pair 6A performs forward rotation to convey the first sheet S1. FIG. 11B is a view illustrating a state in which the reverse conveyance roller pair 6A performs reverse rotation to reverse the first sheet S1. FIG. 12A is a view illustrating a state in which the reverse conveyance roller pair 6A performs forward rotation to convey the first sheet S1 and the second sheet S2. FIG. 12B is a view illustrating a state in which the first reverse conveyance roller 60*a* of the reverse conveyance roller pair 6A performs reverse rotation to reverse the first sheet S1, and the second reverse conveyance roller 60*b* of the reverse conveyance roller pair 6A performs forward rotation to convey the second sheet S2.

Note that, in the second embodiment, the operation performed until the leading edge of the first sheet S1 or the like reaches the reverse conveyance roller pair 6A, and the operation performed after the first sheet S1 or the like is reversed by the reverse conveyance roller pair 6A are the same as those in the first embodiment, and description thereof is therefore omitted herein. The description of the second embodiment is directed to the operation performed after the second sheet S2 is conveyed to the sheet discharge tray 22 side by the reverse conveyance roller pair 6A and until the second sheet S2 is reversed and conveyed to the second conveying path 51. Further, in the following, the "forward rotation" refers to a rotation direction for conveying the sheet S to the sheet discharge tray 22 side, and the "reverse rotation" refers to a rotation direction for reversing the sheet S and conveying the sheet S to the second conveying path 51.

When the leading edge of the first sheet S1 has reached the reverse conveyance roller pair 6A, the first reverse conveyance roller 60*a* and the second reverse conveyance roller 60*b* of the reverse conveyance roller pair 6A perform forward rotation. Specifically, as illustrated in FIG. 11A, in the reverse conveyance roller pair 6A, the third gear 69*a* of the first switching unit 63*a* meshes with the first drive gear 64*a*, and a second gear 68*b* of a second switching unit 63*b* meshes with a second drive gear 64*b*. Accordingly, the reverse conveyance roller pair 6A performs forward rotation, and the first sheet S1 enters between the first reverse conveyance roller 60*a* and the second reverse conveyance roller 60*b*, with the result that the first sheet S1 is conveyed to one side (sheet discharge tray 22 side) of the first conveying path 50 that is divided into two branches on the downstream side.

The trailing edge of the first sheet S1 conveyed by the reverse conveyance roller pair 6A passes through the second sensor 55, and when a predetermined period of time has elapsed since then, the trailing edge of the first sheet S1 passes through a branch point E of the first conveying path 50. When the first sheet S1 passes through the branch point E due to the lapse of the predetermined period of time, the reverse conveyance roller pair 6A starts reverse rotation. Specifically, as illustrated in FIG. 11B, in the reverse conveyance roller pair 6A, the second gear 68*a* of the first switching unit 63*a* meshes with the first drive gear 64*a*, and a third gear 69*b* of the second switching unit 63*b* meshes with the second drive gear 64*b*. Accordingly, the reverse conveyance roller pair 6A performs reverse rotation, and the first sheet S1 is conveyed to the second conveying path 51.

Subsequently, when the leading edge of the second sheet S2 that is being conveyed along the first conveying path 50 passes through the second sensor 55, as illustrated in FIG. 12A, the reverse conveyance roller pair 6A starts forward rotation again. Accordingly, the first sheet S1 that is being conveyed in the reversed state is conveyed again to the sheet discharge tray 22 side. At this time, as illustrated in FIG. 8, the reverse conveyance roller pair 6A nips (receives) the second sheet S2 together with the first sheet S1.

After the second sheet S2 is nipped together with the first sheet S1 by the reverse conveyance roller pair 6A, as illustrated in FIG. 12B, the first reverse conveyance roller 60*a* of the reverse conveyance roller pair 6A performs reverse rotation, and the second reverse conveyance roller 60*b* of the reverse conveyance roller pair 6A performs forward rotation. Specifically, the second gear 68*a* of the first switching unit 63*a* meshes with the first drive gear 64*a* to convey the first sheet S1 to the second conveying path 51. Further, the second gear 68*b* of the second switching unit 63*b* meshes with the second drive gear 64*b* to convey the second sheet S2 to the sheet discharge tray 22 side. Through this operation, the first sheet S1 and the second sheet S2 can be conveyed in such a manner that the first sheet S1 and the second sheet S2 pass each other in different directions even in the overlaid state.

The laser beam printer 1A according to the second embodiment that is structured as described above produces the following effects in addition to the effects produced by the same structure in the first embodiment. The laser beam printer 1A according to the second embodiment includes the reverse conveyance roller pair 6A including the first reverse conveyance roller 60*a* and the second reverse conveyance roller 60*b* capable of changing the rotation direction independently of each other. Therefore, the reverse conveyance roller pair 6A can perform the operation of discharging the sheet S to the sheet discharge tray 22. Accordingly, there is no need to provide the switching member 53 and the sheet discharging path 52 for discharging the sheet that has undergone the duplex printing. As a result, the manufacturing cost can be reduced. Further, the laser beam printer 1A can be reduced in height.

Hereinabove, the exemplary embodiments of the present invention have been described, but the present invention is not limited to the above-mentioned exemplary embodiments. Further, the effects described in the exemplary embodiments of the present invention are taken merely as the most suitable effects produced from the present invention, and hence the effects of the present invention are not limited to the effects described in the exemplary embodiments of the present invention.

This application claims the benefit of Japanese Patent Application No. 2010-230413, filed Oct. 13, 2010, which is hereby incorporated by reference herein in its entirety.

REFERENCE SIGNS LIST

1 laser beam printer (image forming apparatus)
2 printer main body
3 sheet feeding portion (sheet feeding apparatus)
4 image forming portion
5 sheet conveying portion
6, 6A reverse conveyance roller pair
7 reconveying roller pair
7*a* first reconveying roller
7*b* second reconveying roller
8, 8A sheet conveyance control portion
50 first conveying path
51 second conveying path
S sheet
S1 first sheet (sheet that is firstly conveyed)
S2 second sheet (sheet that is secondly conveyed)
S3 third sheet (sheet that is thirdly conveyed)

The invention claimed is:

1. A sheet conveying apparatus which conveys a sheet, comprising:

a first conveying path, along which the sheet is conveyed;

a second conveying path, along which the sheet conveyed from the first conveying path is reconveyed to the first conveying path;

a reverse conveyance roller pair, which performs forward rotation to convey the sheet conveyed from the first conveying path, and thereafter performs reverse rotation to convey the sheet to the second conveying path;

a reconveying roller pair which is disposed in the second conveying path and which reconveys the sheet, which is conveyed through the reverse rotation of the reverse conveyance roller pair, to the first conveying path; and a control portion which causes the reconveying roller pair to nip, in an overlaid manner, a preceding sheet and a succeeding sheet that is conveyed successively to the preceding sheet by the reverse conveyance roller pair, and thereafter rotates a first roller of the reconveying roller pair that is in contact with the preceding sheet while stopping rotation of a second roller of the reconveying roller pair that is in contact with the succeeding sheet so that the preceding sheet is conveyed to the first conveying path and the succeeding sheet stays in the second conveying path.

2. A sheet conveying apparatus according to claim 1, wherein the control portion stops rotation of the reconveying roller pair in a state in which the reconveying roller pair nips only the preceding sheet, and thereafter causes the reconveying roller pair to nip the succeeding sheet so that the succeeding sheet is overlaid on the preceding sheet.

3. A sheet conveying apparatus according to claim 2, wherein, in the state in which the reconveying roller pair nips the preceding sheet and the succeeding sheet, the control portion rotates the second roller while stopping rotation of the first roller to convey the succeeding sheet, and thereafter rotates the first roller while stopping rotation of the second roller to convey the preceding sheet to the first conveying path.

4. A sheet conveying apparatus according to claim 3, wherein, in the state in which the reconveying roller pair nips the preceding sheet and the succeeding sheet, the control portion rotates both of the first roller and the second roller to convey the preceding sheet and the succeeding sheet at the same time.

5. A sheet conveying apparatus according to claim 1, wherein in the state in which the reconveying roller pair nips the preceding sheet and the succeeding sheet in the overlaid manner, another sheet succeeding the succeeding sheet is conveyed in the first conveying path.

6. A sheet conveying apparatus according to claim 5, wherein a trailing edged side of the succeeding sheet conveyed by the reconveying roller pair while being overlaid on the preceding sheet stopped and the leading edge side of the another sheet conveyed in the first conveying path are passed each other at the reverse conveyance roller pair.

7. A sheet conveying apparatus according to claim 1, further comprising a trailing edge retreat portion provided in the second conveying path between the reverse conveyance roller pair and the reconveying roller pair, the trailing edge retreat portion retreating a trailing edge of the sheet when the reconveying roller pair is stopped in a state of nipping the sheet.

8. An image forming apparatus, comprising:

conveying apparatus according to claim 1; and an image forming portion which forms an image on a sheet that is fed from the sheet conveying apparatus.

9. An image forming apparatus according to claim 8, wherein the control portion stops rotation of the reconveying roller pair in a state in which the reconveying roller pair nips only the preceding sheet, and thereafter causes the reconveying roller pair to nip the succeeding sheet so that the succeeding sheet is overlaid on the preceding sheet.

10. An image forming apparatus according to claim 9, wherein, in the state in which the reconveying roller pair nips the preceding sheet and the succeeding sheet, the control portion rotates the second roller while stopping rotation of the first roller to convey the succeeding sheet, and thereafter rotates the first roller while stopping rotation of the second roller to convey the preceding sheet to the first conveying path.

11. An image forming apparatus according to claim 10, wherein, in the state in which the reconveying roller pair nips the preceding sheet and the succeeding sheet, the control portion rotates both of the first roller and the second roller to convey the preceding sheet and the succeeding sheet at the same time.

12. An image forming apparatus according to claim 8, wherein in the state in which the reconveying roller pair nips the preceding sheet and the succeeding sheet in the overlaid manner, another sheet succeeding the succeeding sheet is conveyed in the first conveying path.

13. An image forming apparatus according to claim 12, wherein a trailing edge side of the succeeding sheet conveyed by the reconveying roller pair while being overlaid on the preceding sheet stopped and the leading edge side of the another sheet conveyed in the first conveying path are passed each other at the reverse conveyance roller pair.

14. An image forming apparatus according to claim 8, further comprising a trailing edge retreat portion provided in the second conveying path between the reverse conveyance roller pair and the reconveying roller pair, the trailing edge retreat portion retreating a trailing edge of the sheet when the reconveying roller pair is stopped in a state of nipping the sheet.

* * * * *